US005302807A

United States Patent [19]

Zhao

[11] Patent Number: 5,302,807

[45] Date of Patent: Apr. 12, 1994

[54] ELECTRICALLY HEATED GARMENT WITH OSCILLATOR CONTROL FOR HEATING ELEMENT

[76] Inventor: Zhi-Rong Zhao, 5F, No. 18-1, Lane 143, Hang Chue South Road Sec. 1, Taipei, Taiwan

[21] Appl. No.: 8,354

[22] Filed: Jan. 22, 1993

[51] Int. Cl.[5] ..... H05B 3/00

[52] U.S. Cl. ..... 219/211; 219/549; 219/492

[58] Field of Search ..... 219/211, 549, 492

[56] References Cited

U.S. PATENT DOCUMENTS

| | | | |
|---|---|---|---|
| 4,277,670 | 7/1981 | Mori et al. | 219/511 |
| 4,950,868 | 8/1990 | Moss et al. | 219/211 |
| 5,023,430 | 6/1991 | Brekkestrom et al. | 219/211 |
| 5,032,705 | 7/1991 | Batcheller et al. | 219/211 |
| 5,105,067 | 4/1992 | Brekkestrom et al. | 219/211 |

*Primary Examiner*—Bruce A. Reynolds
*Assistant Examiner*—John A. Jeffery
*Attorney, Agent, or Firm*—Morton J. Rosenberg; David I. Klein

[57] ABSTRACT

An electrically heated garment is provided having the effect of protecting the user against the cold. The garment is made of synthetic fiber fabric, polyurethane foam, polyethylene film, a flexible circuit of aluminum foil, and cotton cloth, formed by hot pressing and gluing each layer in sequence. Furthermore, the two ends of the aluminum foil circuit are connected to the output terminals of a heating control circuit device so that heat energy, which is spread all over the clothes, can be adjusted, raising its temperature to keep the user's body warm. The heating control circuit includes an integrated circuit oscillator whose duty cycle is controlled by a potentiometer, without affecting the oscillation frequency.

2 Claims, 4 Drawing Sheets

ELECTRICALLY HEATED GARMENT WITH OSCILLATOR CONTROL FOR HEATING ELEMENT

FIELD OF THE INVENTION

This invention relates to a type of electrically heated garment having an effect of protecting a user against the cold, which is made by hot pressing and gluing layers of synthetic fiber fabric, polyurethane foam, polyethylene film, a flexible electrical circuit, and cotton cloth in sequence. In addition, conductive wires from two ends of the flexible circuit are extended to the terminals of an electrical device for generating heat energy therefrom.

BACKGROUND OF THE INVENTION

All sorts of clothes on the market are generally divided into two categories: winter clothing and summer clothing. But during freezing weather conditions, no matter what the constituents of the cloth are, a person always needs to put on several heavy clothes to keep the body warm enough. However, this results in a restriction of the person's motion, as well as increasing expenditures for clothing. In Taiwan, cold weather does not often occur during the year. Housewives usually have the distress of not having room for storing family members' winter clothes. Moreover, heaters are not popular in Taiwan, and so people have to wear several layers of clothes in the winter, even staying indoors, which makes people feel tiresome. Children and babies generally do not care for quilts during sleeping, which is one of the reasons that they often catch cold. Such problems exist despite the fact that there are some "belly-bands" on the market, those just produce a local warm effect on the abdomen, not on the whole body. Thus, the function of prior art clothing in keeping the body protected from cold can be improved.

OBJECT OF THE INVENTION

In view of the shortcomings of the prior art, this invention provides an improved design for warm clothing, in which the defects described above have been eliminated.

The construction and features of this invention will become clear from the following detailed description when read in conjunction with the accompanying drawings.

DETAILED DESCRIPTION OF THE PREFERRED EMBODIMENT

Figure 1:
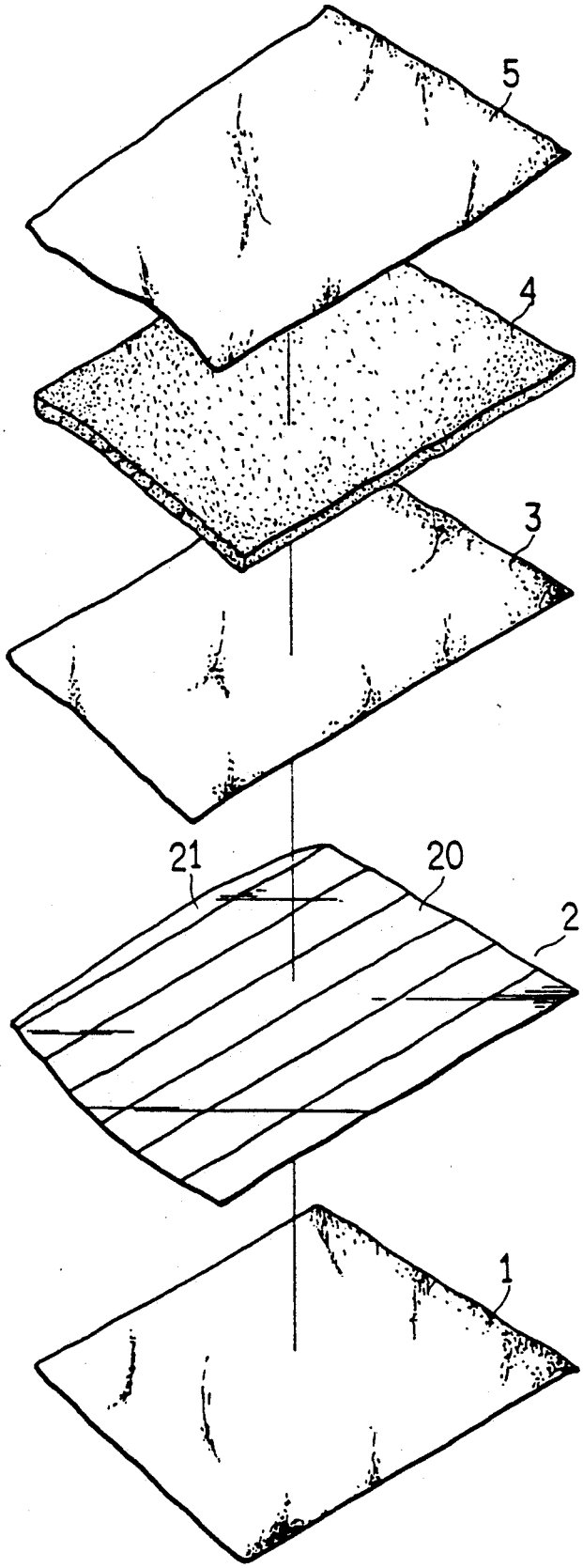
FIG. 1 is a schematic view of the manufacturing method of this invention.
Figure 2:
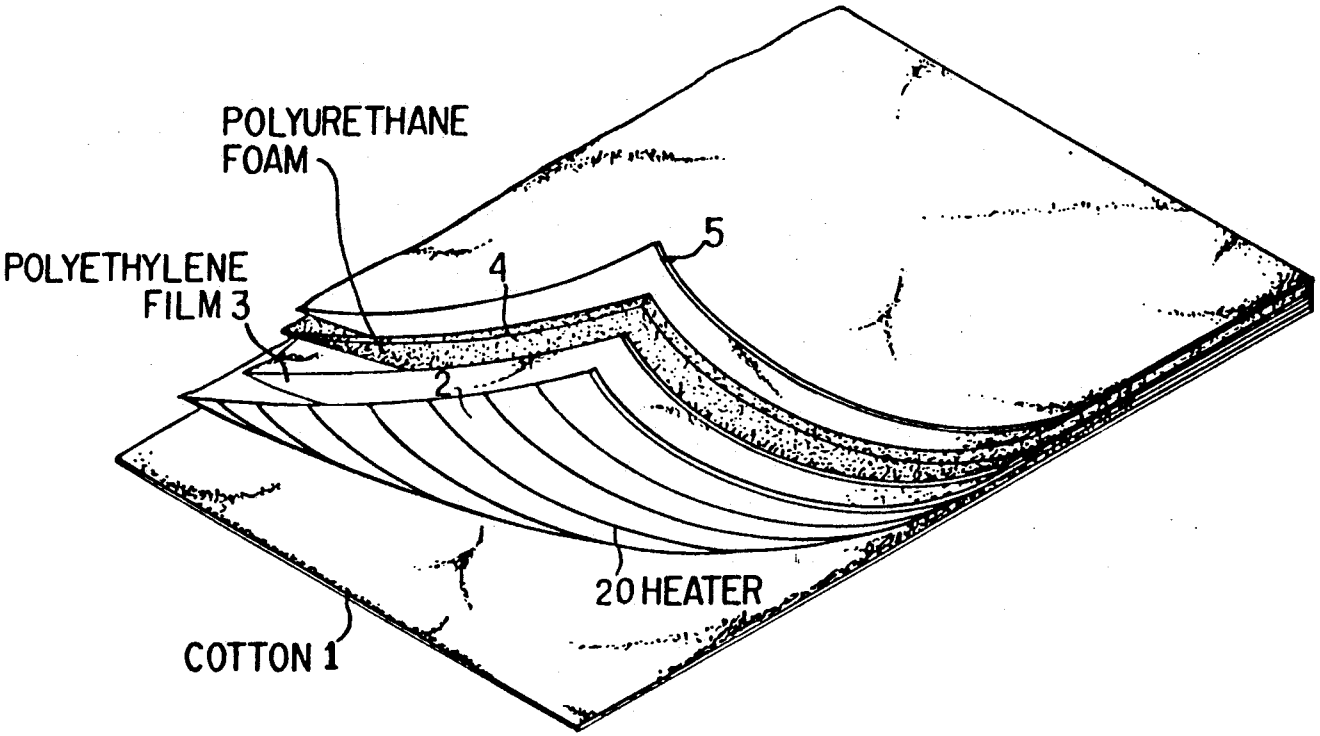
FIG. 2 is a schematic view of the cloth construction according to this invention.
Figure 4:
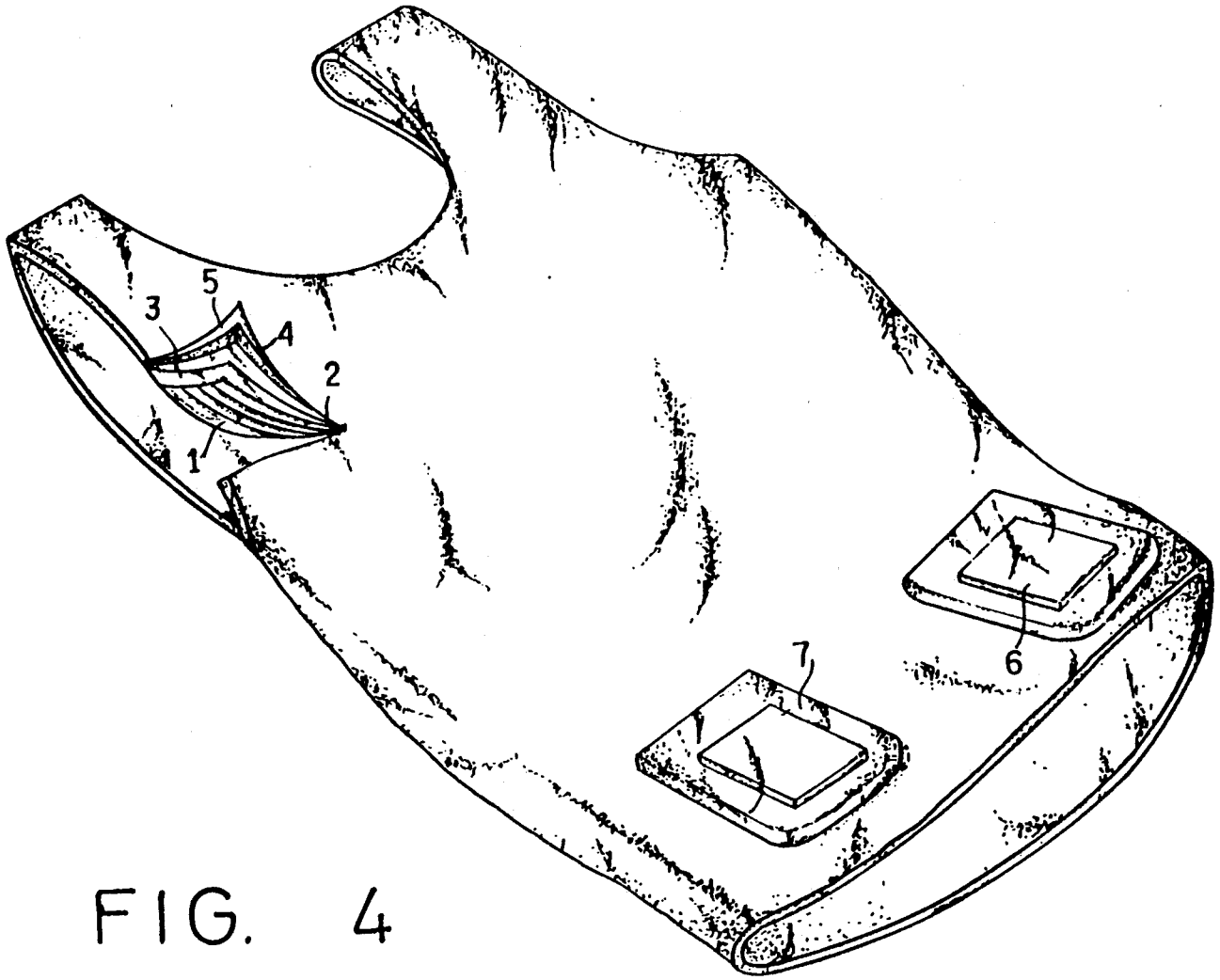

Referring to FIGS. 1 and 2, there is shown, a flexible circuit 2 adhered on a piece of cotton cloth 1 , with insulation evenly covering two sides of the circuit 2, and then polyethylene film 3, polyurethane foam 4, and synthetic fiber fabric 5 being glued in sequence on the upper side of the flexible circuit 2. Finally, a pressing procedure is applied to form the cloth which can be tailored to clothes of diverse styles. FIG. 4 gives an example of a vest for the purpose of illustration. The cloth is made by pressing and so it feels very soft and comfortable. The flexible circuit 2 is made by coiling aluminum foil 20 and then stamping it on a thin insulation 21 while two ends of the foil are connected to the output terminals of a heating electrical control device 6.

Figure 3:
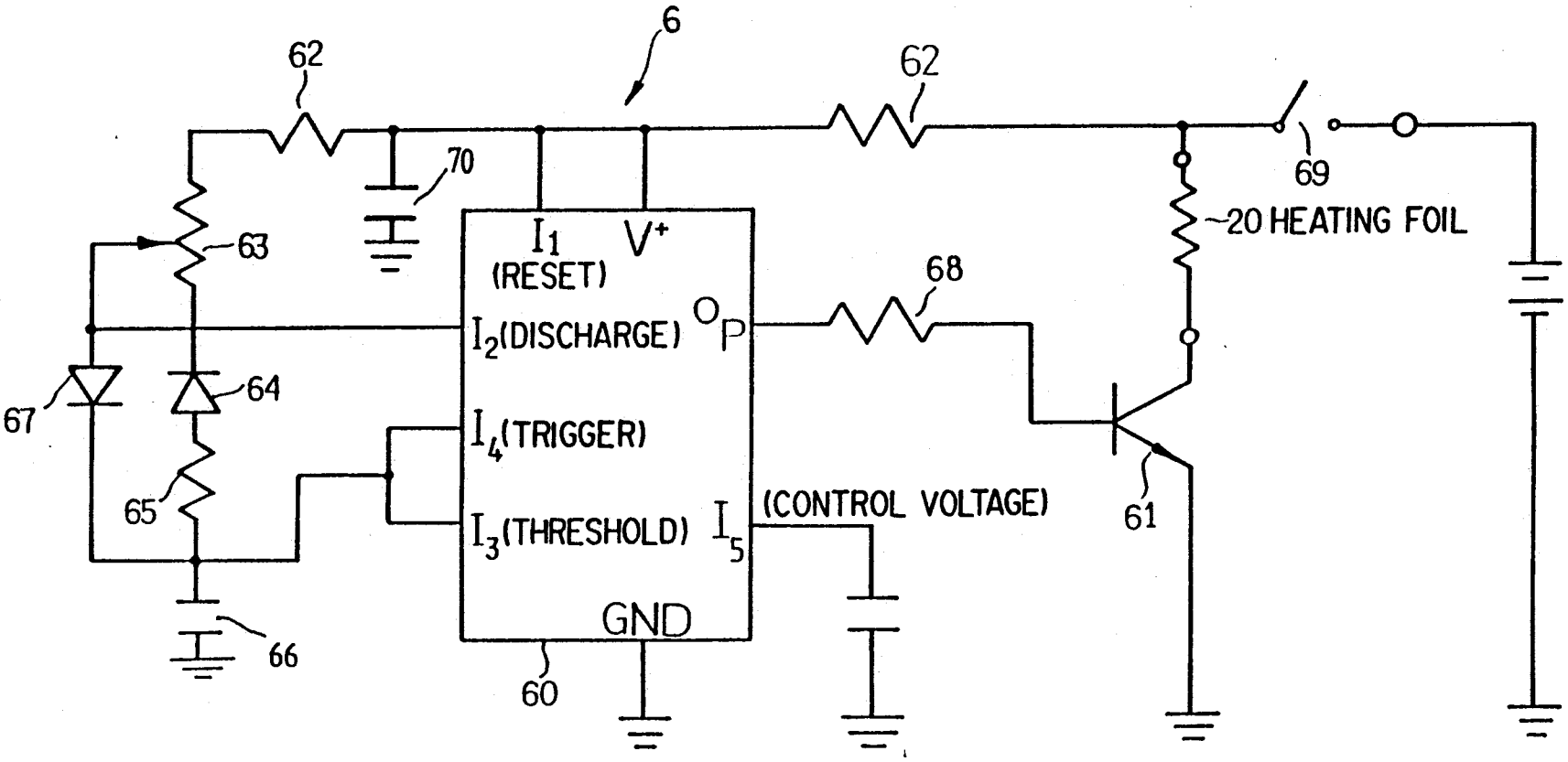
FIG. 3 is a diagram of the circuitry that can be used on the electrical device of this invention; and, FIG. 4 shows a practical example of this invention.

Now referring to FIGS. 3 and 4, the electrical device 6 mainly consists of an integrated circuit 60, a transistor 61 and some accompanying components; the reset terminal I of which integrated circuit in association with resistors 62, a potentiometer 63, a diode 64, a resistor 65 and a capacitor 66 connected to the ground form a series circuit, while the moving contact of the variable resistor 63 is individually connected to the discharge input terminal I of the integrated circuit 60 and also to the trigger input terminal I, and the threshold input terminal $I_3$ connected via a series diode 64. The output terminal $O_P$ is connected to the base of the transistor 61. The transistor 61 functions as common-emitter emitter amplifier and the aluminum foil 20 is coupled to the collector as a load. Batteries 7 supply direct current to the integrated circuit 60, the filter capacitor 70 and heater foil 10, through a switch 69.

To facilitate use in heated clothing applications, the electrical device 6 is soldered on a printed circuit board and disposed within a box which can be put into a pocket of an article of clothing, and the batteries 7 can similarly be placed in the article of clothing, wherein the power wires joining both 6 and 7 and the wires connecting the flexible circuit 2 to the output terminals of the electrical device 6 would be sewn to the interior of the clothing.

When the warming function is desired, the switch 69 is closed to make the circuit active. The integrated circuit 60 will automatically generate an oscillation signal based on the series circuit that is composed of resistors 62, 65, the potentiometer 63 and the capacitor 66. Responsive to the pulse waveform output from integrated circuit 60, the collector current of transistor 61 flows through the load, which produces heat energy. Heat is generated by the aluminum foil 20 and then spreads all over the clothes. Meanwhile, with the help of the polyurethane foam 4, heat flow is impeded, so as not to escape to the outside, and so energy is saved. The adjustment of the variable resistor 63 alters the duty cycle of the integrated circuit 60. The duty cycle of integrated circuit 60 in turn, affects the power output of the transistor 61, attaining the effect of temperature control. The charge time of capacitor 66 being determined solely by potentiometer 63, since diode 64 blocks charging current through resistor 65 and diode 67 provides a current path for charging. Whereas the discharge time constant is determined by both potentiometer 63 and resistor 65, the potentiometer resistance affecting discharge being different than that effecting charge. Thereby, making the operating frequency determined by the sum of the total resistance of potentiometer 63 and resistor 65 and the value of capacitor 66, and independent of the position of the potentiometer's tap.

The method to produce warm clothes according to this invention is simple, convenient, and low-cost. The heat energy generated by the heating element 20, connected to the electrical device 6 is able to propagate from all over the clothing. Therefore, its effectiveness in keeping a person warm is good enough to substitute for heavy winter clothes. More important, the adjustability of heating temperature makes it adaptable to various individual demands, and is therefore of great value.

What is claimed is:

1. An electrically heated garment, comprising:

heating means tailored to form an article of clothing for protecting a user from cold weather, said heating means including (1) a backing layer formed of cotton cloth, (2) a flexible heating element electrically insulated on opposing sides thereof and adhered to said cotton cloth on a bottom surface of said flexible heating element, said flexible heating element being formed by a length of aluminum foil, (3) a polyethylene film layer adhered to an upper surface of said flexible heating element, (4) a polyurethane foam layer overlaying said polyethylene film layer, and (5) a fabric layer formed of synthetic fibers overlaying said polyurethane foam layer;

a battery power source having a first terminal coupled to a first end of said length of aluminum foil; and, controller means electrically coupled to said flexible heating element and said battery power source for controlling electrical energy supplied to said flexible heating element, said controller means including:

a. a transistor amplifier having a collector element coupled to a second end of said length of aluminum foil and an emitter element coupled to a second terminal of said battery power source for completing a current path through said flexible heating element responsive to an oscillation signal having a predetermined frequency applied to a base element of said transistor amplifier;

b. an integrated circuit oscillator having an output coupled to said base element of said transistor amplifier; and, c. means for altering a duty cycle of said oscillation signal output from said integrated circuit oscillator to thereby vary the amount of electrical energy supplied to said flexible heating element, said integrated circuit having a trigger input terminal and a threshold input terminal wherein each are coupled to a first terminal of a capacitor, said capacitor having second terminal coupled to said second terminal of said battery power source, said duty cycle altering means including (1) a potentiometer having a first terminal coupled to said first terminal of said battery power source and a movable tap coupled to a discharge input terminal of said integrated circuit oscillator and coupled to an anode of a first diode, said first diode having a cathode coupled to both said trigger input terminal and said threshold input terminal for establishing a charge RC time constant dependent solely on a first resistance portion of said potentiometer defined between said first potentiometer terminal and said movable tap, and (2) a resistor having one end coupled to both said trigger input terminal and said threshold input terminal and an opposing end coupled in series relation with a second terminal of said potentiometer and a second diode, said second diode having a cathode coupled to said second terminal of said potentiometer for establishing a charging RC time constant determined by said resistor and a second portion of said potentiometer defined between said movable tap and said second terminal, whereby a duty cycle of said oscillation signal is variable without affecting said predetermined frequency thereof.

2. The electrically heated garment ar recited in claim 1 where each of said battery power source and controller means are disposed within pockets formed in said article of clothing.

* * * * *